United States Patent [19]
Swearingen
[11] 4,300,869
[45] Nov. 17, 1981

[54] METHOD AND APPARATUS FOR CONTROLLING CLAMPING FORCES IN FLUID FLOW CONTROL ASSEMBLIES

[76] Inventor: Judson S. Swearingen, 2235 Carmelina, Los Angeles, Calif. 90064

[21] Appl. No.: 120,478
[22] Filed: Feb. 11, 1980
[51] Int. Cl.³ ..... F01D 17/16
[52] U.S. Cl. ..... 415/160; 415/164
[58] Field of Search ..... 415/156, 160, 161, 162, 415/163, 164, 113

[56] References Cited

U.S. PATENT DOCUMENTS 3,232,581 2/1966 Swearington ..... 415/164 X
3,495,921 2/1970 Swearington ..... 415/163

*Primary Examiner*—Leonard E. Smith
*Attorney, Agent, or Firm*—Lyon & Lyon

[57] ABSTRACT

Disclosed are apparatus for controlling fluid flow including a circumferential plurality of blades mounted between a parallel pair of axially spaced annular elements. The interstitial passages between the blades may be varied by the relative rotation of one annular element functioning as a ring actuator with respect to the stationary second annular element. The orientation of the circumferential blades is adjusted in unison by cam type engagements between one of the annular elements and the blades. An appropriate axial clamping force is applied to the assembly to frictionally secure the blades between the annular rings and to prevent end leakage of the fluid between the annular rings and the blade faces adjacent to the rings. Variation in the clamping forces acting on the blades as the blades are pivotally rotated to vary the passage cross sections therebetween may be controlled by providing pressurizable pockets in the blade faces adjacent to one or both of the annular elements. Such pockets may also be provided in one or both of the annular elements, alone or in combination with pockets in the blades. Fluid pressure is communicated to, or vented from, the pockets at various orientations of the blades, thus controlling the clamping force magnitude for any given blade orientation.

16 Claims, 9 Drawing Figures

FIG. 3
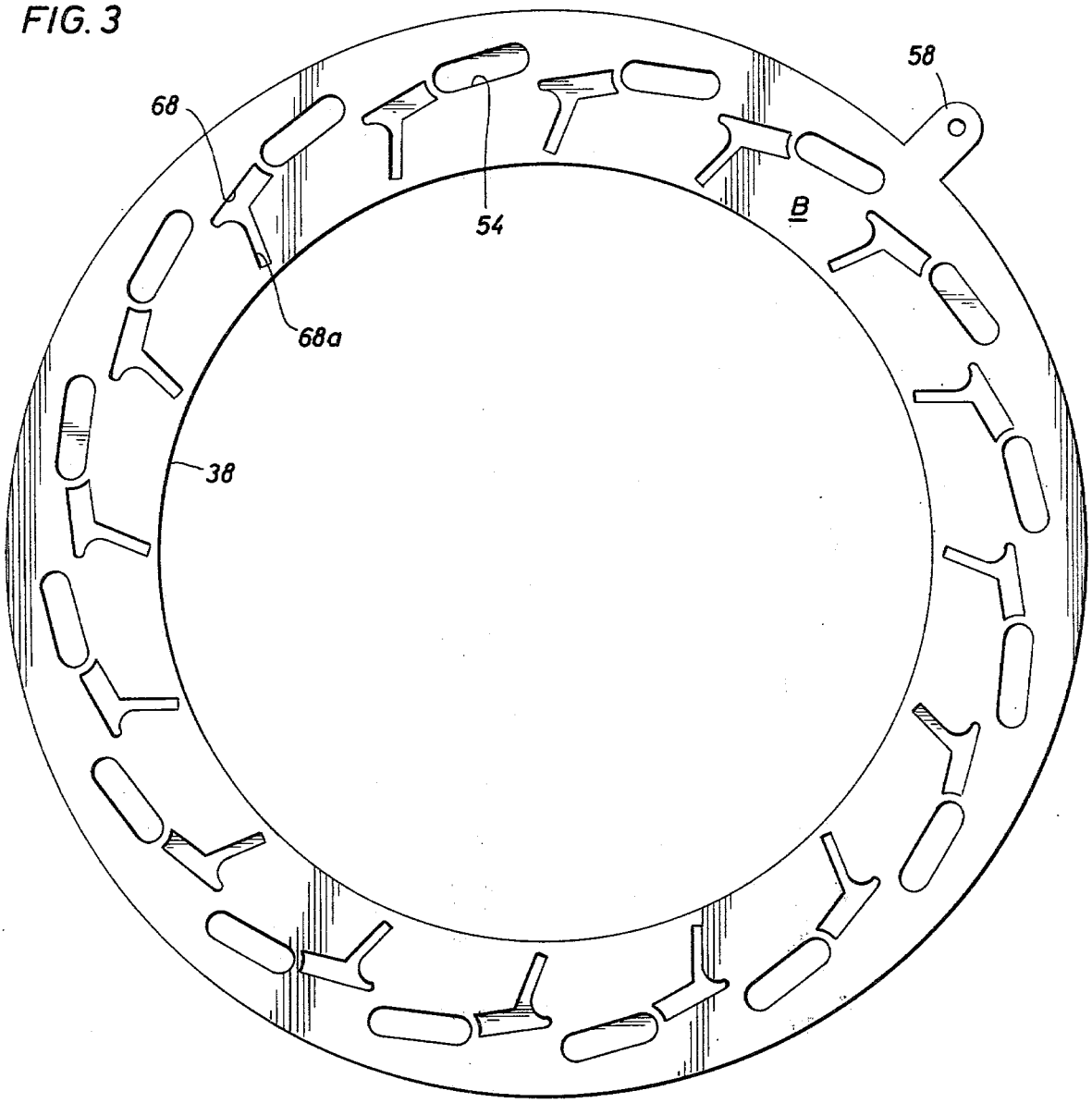
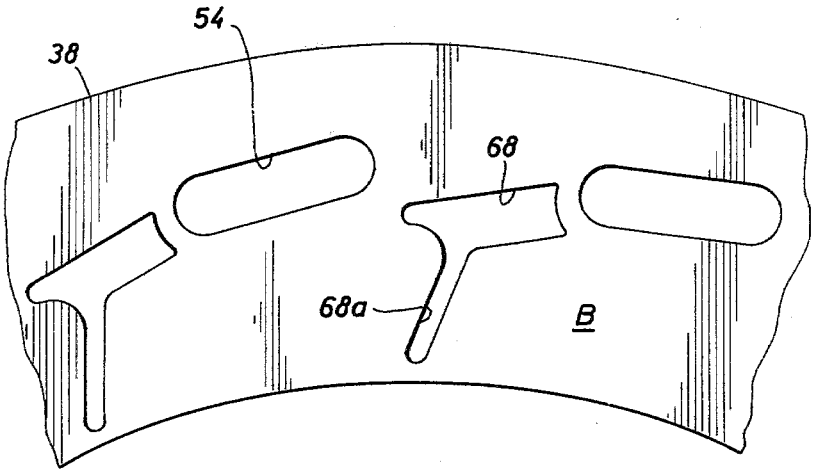
FIG. 4

METHOD AND APPARATUS FOR CONTROLLING CLAMPING FORCES IN FLUID FLOW CONTROL ASSEMBLIES

BACKGROUND OF THE INVENTION

1. Field of the Invention

The present invention pertains to methods and apparatus for providing fluid flow control assemblies for fluid-handling machinery. More particularly, the present invention relates to techniques for controlling the axial clamping forces on adjustable radial blade assemblies in fluid-operable systems. The present invention finds particular application to radial turbines and compressors wherein variable pressure profiles across the blades and annular parallel rings cause wide variations in the ring clamping forces on the blades as the orientation of the blades is altered to change the width of the interblade flow passages.

2. Description of the Prior Art

In the case of radial turbines and some other fluid-handling rotating machinery, pressurized fluid is communicated into the turbine wheel, or rotor, through an array of circumferentially arranged nozzles. The flow of fluid through the nozzle assembly may be varied by pivotally adjusting the nozzle blades so as to vary the flow area passageway between adjacent nozzle blades. Similarly adjustable diffuser blades or vanes may be arranged in a circumferential array in a compressor.

In one type of a variable nozzle turbine, the nozzle passages are formed by a collection of rotatable blades positioned between a pair of axially-spaced parallel rings. Complimentary portions of adjacent nozzle blades, along with portions of the adjacent ring surfaces, form the nozzle passages. Each blade is pivotally mounted on a pin fixed to one of the rings, and a second pin affixed to the opposite ring engages an offset cam slot in the nozzle blade. Rotation of the second, or actuator, ring effects a camming operation to rotate the blades in unison around their respective pivot pins to alter the distance between adjacent blades and, therefore, to vary the flow area passageway between adjacent nozzle blades.

U.S. Pat. No. 3,232,581 discloses a variable nozzle arrangement in which the pressure of the inlet fluid is utilized to generate appropriate clamping forces among the nozzle assembly components, such forces being sufficient to prevent leakage between the nozzle blade end walls and annular ring surfaces, but not so great as to prevent or impede the operation of the nozzle adjustment mechanism. The clamping force is determined at least in part by the selection of an effective seal diameter located generally between the minimum and maximum diameters on the outside of the annular nozzle actuator ring. Such seal operates to separate high pressure inlet fluid from the lower pressure fluid at the exit of the nozzles and within the turbine rotor housing. The high and low pressure zones thus separated act on their respective outside areas of the annular actuator ring. The resultant force acting on the outside of the ring is opposed by the resultant force determined by the pressure profile existing within the nozzle assembly and acting on the inside exposed area of the actuator ring. The effective seal diameter is thus chosen such that a net compression, or clamping force, of sufficient magnitude will be created for the purpose of sealing the nozzle blade end walls against the inside annular surfaces.

U.S. Pat. No. 3,495,921 discloses a variable nozzle arrangement in which the inside surfaces of the annular rings have been relieved slightly. This feature is helpful in overcoming certain limitations associated with control of the clamping force on the nozzle assembly merely by selection of an effective outside seal diameter as described above in U.S. Pat. No. 3,232,581. Because of variation in the opposing resultant force pattern acting upon the inside annular walls of the nozzle assembly as the nozzle blade orientation is adjusted to contol the flow, the net compressional clamping force does not remain constant. In the selection of an effective outside sealing diameter, consideration is given to maintaining at least a minimum clamping force with the nozzle blades in a closed position. As the nozzles are opened, changes in the resultant force pattern within the assembly will act in a manner to decrease opposition to the compression force acting on the outside of the actuator ring, thereby resulting in an increase in the net clamping force. In applications utilizing high inlet pressures, the clamping force may thus increase to such magnitudes as would impede operation of the nozzle adjustment mechanism.

The improvement introduced in U.S. Pat. No. 3,495,921 involves controlling the variation in the resultant force pattern acting on the inside of the annular rings by tapering or otherwise relieving the annular rings such that the exposed inner surfaces of the annular rings are subject to essentially constant and equivalent pressures regardless of blade orientation.

SUMMARY OF THE INVENTION

The present invention provides pressurizable pockets in the end walls, or faces, of blades which are circumferentially arranged and which engage adjacent parallel annular surfaces to form a fluid flow control assembly. The pockets may be provided in one or both of the annular surfaces, exclusive of or in combination with pockets in the blade faces. The pockets are selectively pressurized to offset objectionable excessive or deficient clamping forces acting on the assembly.

A fluid flow control assembly according to the present invention includes a housing featuring a fluid inlet and a fluid outlet. A wheel, or rotor, is rotatably mounted on an axis within the housing. A first annular element, which may be provided in the form of a fixed ring, is positioned coaxially about the same axis. An actuator, which may be provided in the form of a ring, includes a second parallel annular element coaxially positioned about the same axis and axially displaced from the first annular element. A plurality of blades, or vanes, is arranged generally between opposed first and second annular clamping surfaces of the first and second annular elements, respectively, in a circumferential pattern symmetric about the axis to form a stator. A plurality of fluid flow passages equal in number to that of the blades is thus defined by the blades cooperating with the respective opposed surfaces of the first and second annular elements.

The blades are so mounted in relation to the first and second annular elements, or rings, that the actuator may be selectively rotated relative to the fixed ring to vary orientation of each of the blades simultaneously to correspondingly vary the throat cross sectional area of each of the passages.

The end wall, or face, of each blade adjacent either the first or second annular element, or all of the blade end walls, may feature one or more fluid pressure communication passages for communicating fluid pressure along such face. The passages are generally in the form of depressions or pockets. The shape, position and orientation of the depression relative to the blade in conjunction with pressurizing means will determine the extent and circumstances of fluid pressure communication for the different orientations of the blade relative to the first and second annular surfaces. Such factors, as well as the number of the depressions in each blade, are determined in accordance with the need to minimize variation in the clamping forces as the blade orientation is altered. However, the pattern of blade surface depressions may be the same for all blades in the assembly.

The first and/or second annular surface to which the blade end wall depressions are adjacent may be provided with one or more passageways, or slots, for each blade. The various slots for each blade communicate with different pressure areas. In one or more of the various orientations that may be assumed by the blades, the slots in the annular surface communicate with one or more depressions in each blade end wall. For other orientations of the blades, one or more, or all of the depressions may be sealed against communication with the slots. The fluid pressure throughout the area encompassed by any depression so communicating with a surface slot generally tends to equalize with the pressure in that slot.

Two slots in one of the annular surfaces may be interconnected by a shallow leak passage to permit relatively gradual change in fluid pressure communication between the two slots and a given depression. The two slots may be designed to overlap a single depression so as to achieve a gradual pressure change in the overlapped depression as the blade orientation is altered. Also, in cases where depressions are positioned on opposite sides of the blades, throughbores may be provided to link corresponding depressions on the two opposite end walls of each blade. Then, only one of the first or second annular surfaces need be equipped with passages, or slots, for selectively communicating with the blade pockets.

Depressions incorporated within the nozzle blade may also include throttling orifices for venting purposes, eliminating the need for communication with, and incorporation of multiple vent slots within the annular surfaces. In such event, a single slot in the annular surface may be provided for pressure communication purposes only.

One or both of the annular clamping surfaces may feature one or more fluid pressure communication passages, in the form of depressions or pockets, for one or more or all of the blades. The annular surface depressions may be employed in combination with, or exclusive of, blade face depressions. Generally, the annular surface depressions are designed and positioned to be "covered" by the blades to varying degrees depending, for example, on the orientations of the blades. A port may communicate between a high pressure area in the fluid flow passage and an annular surface depression enclosed by a blade face, with the port sealed by the blade face for selective orientations of the blade. A second port may selectively communicate between a low pressure area and the annular surface depression for selected orientations of the blade. A throttling orifice, or vent, may be provided in the annular surface to communicate between an annular surface depression and, for example, a low pressure area. Where such depressions are provided in both opposing annular surfaces, throughbores in the corresponding blades may be employed to link annular surface depressions on opposite sides of a blade.

The shape, position and orientation of depressions in the annular surface, as well as the number of such depressions per blade affect the extent of fluid pressure communication between the blade faces and the annular surfaces for various blade orientations. Such factors are determined in accordance with the need to minimize variation in the clamping forces as the blade orientation is altered. The pattern of annular surface depressions may be the same for all blades in the assembly.

It will be appreciated that the number, position, shape and orientation of the blade surface depressions and/or the annular surface depressions, and the number, position, shape and orientation of various slots and/or ports and vents may be chosen to effect a wide variety of pressure changes within the regions defined by mutual contact between the blade end walls and the adjacent annular surfaces. For example, slots and/or ports may be provided in one or both of the first or second annular surfaces to selectively communicate fluid pressure from high fluid pressure regions of the flow passages to one or more depressions per blade for selected positions of blade orientation. Similarly, low pressure regions of the flow passages may be communicated with the depressions by selective positioning of slots, or vents, in one or both of the annular surfaces. Generally, a slot or port may serve to communicate relatively high fluid pressure to a depression as well as to vent fluid pressure from the depression.

The present invention provides a technique for maintaining a relatively constant clamping force on the blade assembly as the blade orientation is adjusted to vary the flow passage cross-sectional area. Further, the blade depressions may be used in conjunction with general relieving or tapering of the first and/or second annular surfaces to minimize the variation of pressure distribution on the annular surfaces which occurs in conjunction with flow passage adjustment. Such relieving is described in the aforementioned U.S. Pat. No. 3,495,921, which is hereby incorporated herein by reference.

BRIEF DESCRIPTION OF THE DRAWINGS

FIG. 3 is an enlarged plan view of an actuator ring that may be used with the turbine of FIG. 1 according to the present invention;

FIG. 4 is an enlarged view of a portion of the actuator of FIG. 3;

DESCRIPTION OF THE PREFERRED EMBODIMENTS

While the present invention finds application to radial fluid flow control mechanisms in general, including compressors, details of the incorporation of the invention in a turbine are described herein for purposes of illustration rather than limitation.

Figure 1:
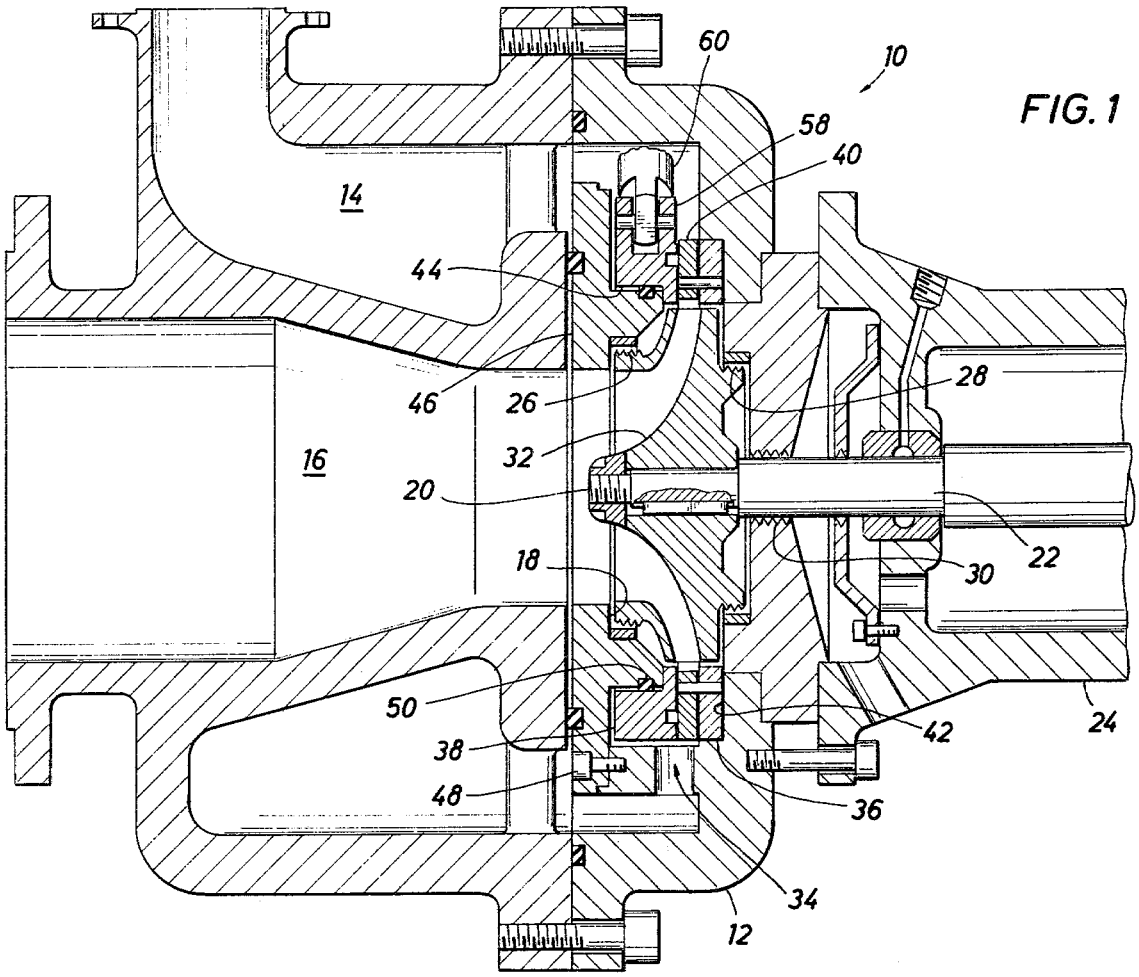
FIG. 1 is a cross section through a variable nozzle turbine constructed in accordance with the present invention, the section taken generally along the axis of the turbine; p

A variable nozzle turbine is shown generally at 10 in FIG. 1, and includes a housing 12 provided with a fluid inlet 14 and an axial fluid outlet, or discharge, 16. Between the fluid inlet and outlet is a turbine wheel compartment 18 containing a turbine wheel, or rotor, 20 mounted on a shaft 22. The common axis of cylindrical symmetry of the turbine wheel 20 and shaft 22 is coincident with the like axis of the fluid outlet 16. The shaft 22 extends through a casing 24 to additional equipment not further described or specified herein. Appropriate rotary seals 26 and 28 maintain fluid-tight integrity between the turbine wheel 20 and the housing 12. Thus, fluid entering the housing 12 through the inlet 14 is constrained to passage through the turbine wheel 20 to achieve the outlet 16. An appropriate rotary seal 30 also impedes fluid flow into and out of the housing 12 along the shaft 22. Further details of the general construction of the housing 12, though not discussed herein in detail, may be appreciated by reference to FIG. 1.

The turbine wheel 20 includes a plurality of fluid flow passages 32 for receiving fluid flow from the inlet 14 and discharging same into the outlet 16. The turbine passages 32 are curved to receive the input fluid flow detected perpendicularly to the turbine axis, and to discharge the fluid flow into the outlet 16 directed generally axially. A nozzle assembly shown generally at 34 circumscribes the turbine wheel 20 and is positioned coaxially therewith. The nozzle assembly 34 includes a stationary clamping ring 36 and an actuator in the form of a clamping ring 38. A plurality of nozzle blades 40 is sandwiched between the two rings 36 and 38 and cooperates therewith to form a plurality of nozzle fluid flow passages.

The fixed ring 36 is seated within an annular recess 42 in the wall of the housing 12, and held thereby against radial movement. The actuator ring 38 includes an annular recess 44 which generally receives an axially extending shoulder of a bearing ring 46 rigidly mounted within the housing 12 by a plurality of bolts 48. A ring seal 50 provides a fluid-tight seal between the actuator ring 38 and the bearing ring 46. The fit of the actuator ring 38 relative to the bearing ring 46 is such as to permit a small amount of axial movement by the actuator relative to the bearing ring and, therefore, relative to the fixed ring 36.

As is well known, fluid propelled through the nozzle system from the inlet 14 toward the turbine wheel 20 undergoes a pressure drop within the nozzle fluid flow passages. The fluid pressure acting axially on the surface of the actuator 38 adjacent to the nozzle blades 40 thus varies depending on the gradient of the pressure differential through the nozzles. However, the axially opposing fluid pressures acting on the annular surfaces of the actuator 38 which are perpendicular to the turbine axis generally exhibit two values: a high pressure acting on the outside surface of actuator 38 on the upstream side of the ring seal 50 and exhibiting the value of the fluid pressure at the upstream entrance to the nozzle assembly; and a lower average pressure acting on the opposite inside surface of the actuator 38, the value of which is determined by the pressure gradient of the fluid as it flows from the inlet to the outlet of the nozzle assembly at the turbine wheel 20. The net axial force acting on the actuator ring 38 may be referred to as the clamping force. When the clamping force is directed toward the nozzle blades 40, the effect of the force is to urge the actuator ring 38 axially against the nozzle blades. The rings 36 and 38 and the blades 40 are then sufficiently clamped together to prevent fluid leakage between the surfaces of the blades and the adjacent ring surfaces. When the clamping force is negative, the actuator 38 is urged away from the blades 40, permitting fluid flow between the adjacent surfaces of the blades and the rings 36 and 38.

As discussed in U.S. Pat. No. 3,495,921, the diameter of the ring seal 50 may be chosen to prevent negative clamping forces. Further, the surfaces of the rings 36 and/or 38 adjacent the blades may be relieved, or tapered, as discussed in the U.S. Pat. No. 3,495,921 to minimize the variations in the nozzle pressure gradient, and therefore clamping force, as the nozzle openings are varied by adjustment of the blades.

Figure 2:
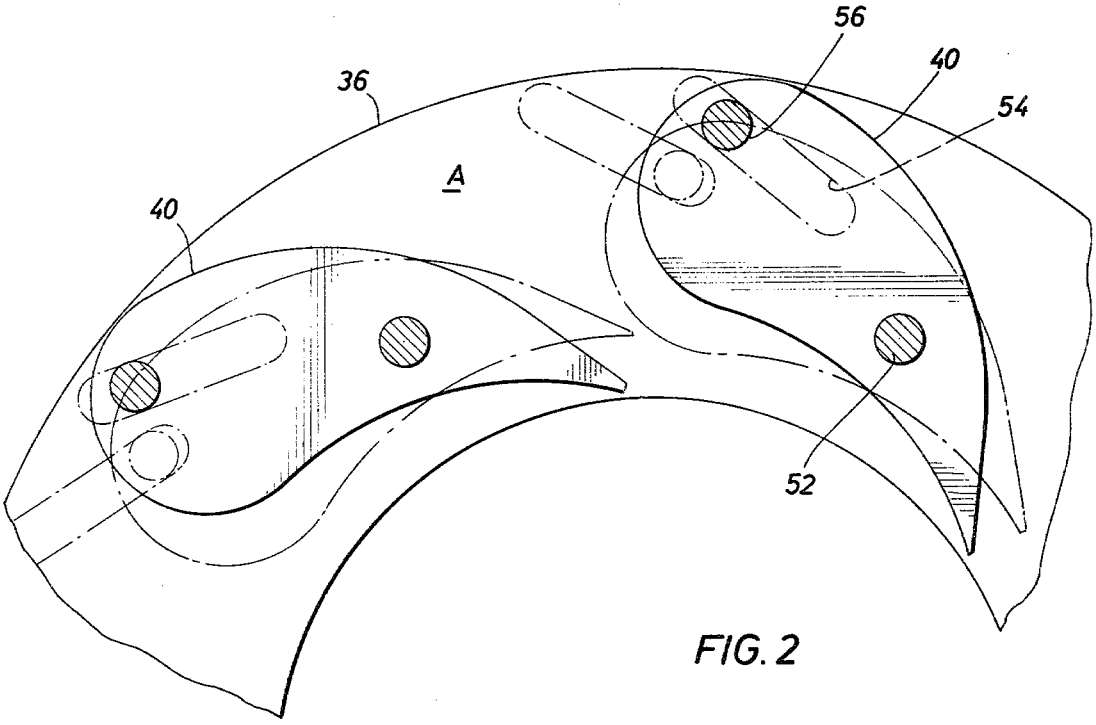
FIG. 2 is an enlarged plan view of a portion of a variable nozzle assembly showing two nozzles blades, but without fluid pressure communication passages of the present invention.

The nozzle blades 40 are air foil in shape, as indicated in FIG. 2. However, any shape for the blades may be employed in conjunction with the present invention. Two nozzle blades 40 are shown in FIG. 2 positioned on the fixed clamping ring 36. Each blade 40 is joined to the ring 36 by a pivot pin 52 passing through appropriate holes in the blade and the ring 36. The axis about which the blade 40 may be rotated relative to the ring 36 is perpendicular to the ring surface A adjacent to the blades.

The actuator clamping ring 38 is illustrated in FIG. 3 with an enlarged portion thereof shown in FIG. 4. With the clamping rings 36 and 38 sandwiching the nozzle blades as illustrated in FIG. 1, the surface B of the actuator ring sealingly engages the face of each blade 40 opposite the blade face sealingly engaged by the surface A. A plurality of camming slots 54, equal in number to the nozzle blades 40, is arranged symmetrically about the actuator 38. Each blade 40 is equipped with a second pin 56 which is received by a corresponding camming slot 54 when the nozzle system is so assembled. Then, the blades 40 are constrained to specific orientations relative to the respective pivot pins 52 depending on the rotational position of the cam slots 54 relative to the pivot pins 52. The slots 54 are generally oblong and are oriented at angles relative to the circumference of the ring 38 to effect rotation of the blades 40 about the pivot pins 52 upon rotation of the actuator ring about the central turbine axis. As may be appreciated by reference to FIG. 2 wherein the locations of the camming slots 54 are indicated in phantom, as the rotational orientation of the actuator ring 38 is varied, the position of each pivot pin 56 within the corresponding camming slot 54 varies. Thus, movement of the camming slots 54 relative to the pivot pins 52 effects rotation of the pivot pins 56 and, therefore, of the blades 40 relative to the corresponding pivot pins 52. Such simultaneous rotation of the nozzle blades 40 varies the cross section of the fluid flow passages defined between adjacent blades.

For example, FIG. 2 illustrates, in solid line, the orientation of two adjacent blades 40 providing maximum spacing between the blades. By broken line, FIG. 2 illustrates a second orientation of the two blades 40 to reduce the interstitial passage between the blades. Further reduction may be utilized to close the nozzle flow passages completely.

The actuator clamping ring 38 is equipped, on its outer circumference, with a clevis 58 to which an actuator rod 60 (FIG. 1) may be pivotally connected. Selective manipulation of the actuator rod 60 is used to rotate the actuator clamping ring 38 about the turbine axis to orient the nozzle blades 40 to achieve the desired nozzle passage opening.

Figure 5:
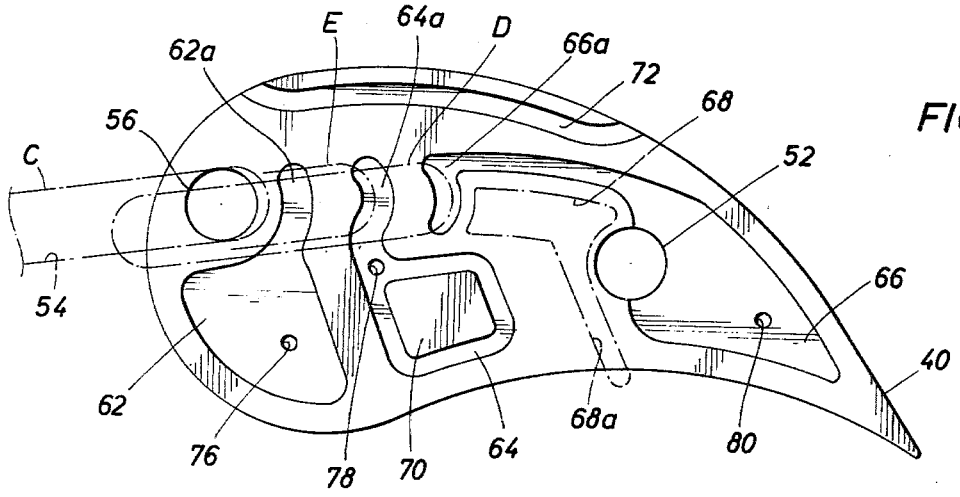
FIG. 5 is a plan view of a nozzle blade illustrating a system of blade end wall depressions and blade throughbores.
Figure 6:
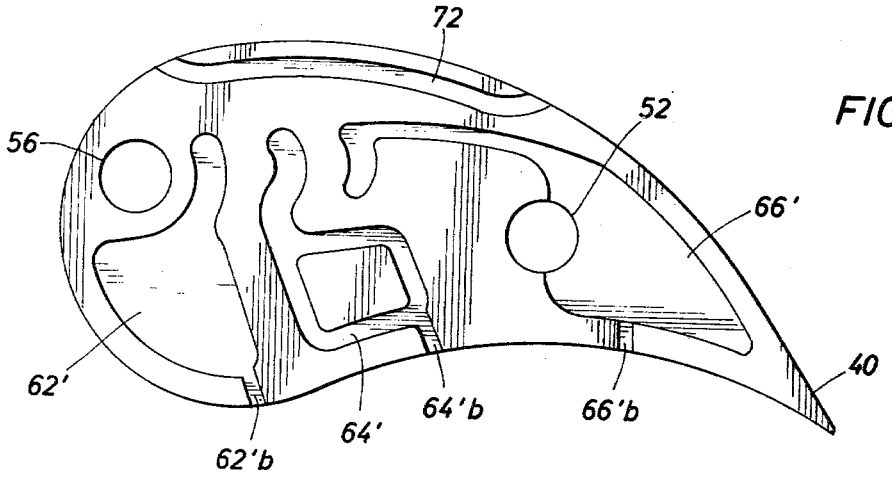
FIG. 6 is a plan view of a nozzle blade featuring generally the same depression system shown in FIG. 5, but including throttled vents.
Figure 7:
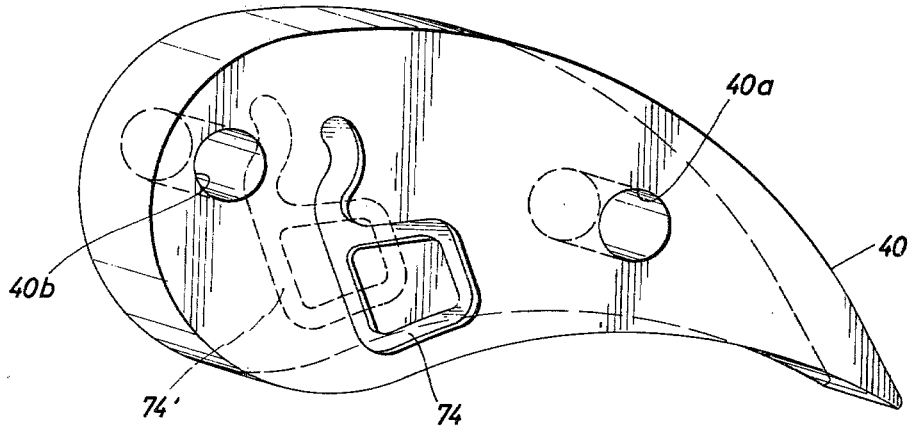
FIG. 7 is a perspective view of a nozzle blade illustrating the positioning of corresponding depressions on opposite faces of the blade.

As discussed in U.S. Pat. No. 3,495,921, the sealing surface B of the actuator clamping ring 38 is exposed to varying total pressure as the nozzle blades 40 are rotated to alter the nozzle fluid flow passage cross sections. Similarly, the total fluid pressure acting on the surface A of the fixed clamping ring 36 varies accordingly. To minimize such pressure variations acting on the surfaces A and B, each blade features, on one or both of its plane faces sealingly engaging the surfaces A and/or B, one or more shallow pockets, or depressions, as illustrated in FIGS. 5–7. While the number, size, shape and arrangement of the pockets are determined in conjunction with the requirements of the specific fluid flow control assembly in which the blades are mounted, for purposes of illustration and explanation, specific pocket systems are considered herein.

In FIG. 5 are illustrated three pockets 62, 64 and 66, each equipped with a generally arc shaped port, or gate, 62*a*, 64*a* and 66*a*, respectively. The gates 62*a*–66*a* are used to selectively communicate high or low fluid pressure to the corresponding pockets 62–66 as the blade 40 is rotated by the actuator ring 38. The position of the corresponding camming slot 54, relative to the face of the blade 40, is shown in phantom for three cases of the orientation of the blade. In the closed nozzle configuration, the camming slot 54 is at the position indicated by C, and does not overlap any of the gates 62*a*–66*a*. Consequently, the camming slot 54 is fluid sealed from communication with any of the pockets 62–66 by sealing engagement between the face of the blade 40 and the surface B of the actuator ring 38. In the full open configuration of the nozzle passages, the camming slot 54 is located at the position indicated by D in FIG. 5, and overlaps all three gates 62*a*–66*a*. In this case, fluid pressure is communicated to the pockets 62–66 from the camming slot 54. Since the camming slots extend toward the upstream side of the nozzle blade system where the fluid pressure in the nozzle system is highest, the camming slots are always exposed to high fluid pressure. In position D, then, the camming slot 54 communicates high fluid pressure to each of the pockets 62–66. An intermediate nozzle opening configuration places the camming slot 54 in the relative position indicated by E in FIG. 5, wherein only the gates 62*a* and 64*a* communicate with the camming slot. In that case, only pockets 62 and 64 are exposed to the high fluid pressure present at the upstream entrance to the nozzle system. The third pocket 66 remains sealed from communication with such high fluid pressure.

The actuator ring 38 is also equipped with a plurality of vent slots 68, each equipped with a neck 68*a* extending toward the radially inner edge of the ring 38 and, therefore, to the low fluid pressure region of the downstream outlet of the nozzle assembly. The position of the vent slot 68 is shown superimposed on the face of the nozzle blade 40 in FIG. 5 for the full open configuration. In the case so illustrated, the vent slot 68 is sealed from communication with each of the pockets 62–66 in this configuration. However, it will be appreciated that, as the actuator clamping ring 38 is rotated about the turbine axis to vary the orientation of the blades 40, the vent slot 68 corresponding to each blade 40 and shifts position with the camming slot 54 relative to the corresponding blade. Thus, for the intermediate position E of the camming slot 54 shown in FIG. 5, the vent slot 68 corresponding to a given blade 40 overlaps the gate 66*a* to communicate fluid pressure between the pocket 66 and the downstream, low pressure area reached by the neck 68*a*. For the intermediate configuration illustrated, the pockets 62 and 64 are exposed to high fluid pressure while the pocket 66 is exposed to low fluid pressure. Accordingly, that portion of the actuator ring surface B adjacent the pockets 62 and 64 will be exposed to high fluid pressure, and that portion of the surface B adjacent the pocket 66 will be exposed to low fluid pressure. Similarly, in the closed configuration wherein the camming slot 54 is at the position C, all three gates 62*a*–66*a* are overlapped by, and communicate with, the vent slot 68, thereby venting the fluid pressure within the pockets 62–66 to the relatively low value at the outlet side of the nozzle assembly. From the foregoing discussion it will be appreciated that, with the fluid flow passages full open, the portion of the actuator ring surface B overlapped by the face of the blade 40 will be exposed to maximum fluid pressure. In the closed configuration, the same amount of the area of the surface B will be exposed to a minimum fluid pressure. In the intermediate configuration illustrated, the same size area of the surface B will be exposed to an intermediate total fluid pressure.

The pressurization of the pockets 62–66 to high or low pressure as described occurs generally in discrete steps. However, the slots 54 and 68 may and be positioned relative to the gates 62*a*–66*a* so that the slots effectively overlap in communicating with the gates. As the nozzle assembly is adjusted through the range of configurations of the blades, the slot 68 may be positioned to overlap a particular gate while the cam slot 54 is also in communication with the same gate. Then, as the nozzle passages are being reduced in area, high fluid pressure in a given pocket will be venting to the low pressure area of the nozzle system at the same time high fluid pressure is being communicated into the pocket by the cam slot. As more area of the gate is exposed to the low pressure vent slot, less area of the gate communicates with the high pressure cam slot. Similarly, as the nozzle passages are being opened to a larger cross section, an individual pocket gate may be overlapped by the high pressure cam slot while that same gate is still in fluid communication with the low pressure vent slot. Then, high pressure fluid will begin flowing into the gate and, therefore, the corresponding pocket at the same time that fluid is being vented to the low pressure side of the nozzle assembly. As the blade 40 is rotated, a greater area of the gate is exposed to high pressure cam slot as a lesser area of the gate is exposed to the low pressure vent slot.

An alternate technique for achieving a smoother transition of pressures among the blade pockets involves directly connecting the two slots 54 and 68. A tapered, narrow neck joining the ends of the two slots 54 and 68 may be utilzed for this purpose. Then, within a specific range of blade configurations, a given pocket gate may be exposed for fluid communication with only the narrow neck joining the two slots, for example. In such case, the gate is in fluid communicaion with both the high pressure slot 54 and the low pressure slot 68 simultaneously but through the narrow neck, which permits fluid flow at a restricted rate.

Variations in the design of the high and low pressure slots may be utilized to achieve any of a variety of possible patterns for relatively smooth pressure transition among the blade pockets as desired and appropriate for the given application. Since the pockets and the corresponding gates are relatively shallow, (on the order of a few thousandths of an inch deep) simultaneous communication between a given gate and the two slots 54 and 68 at differing pressures permits only insignificant leakage between the two slots.

The pocket 64 in FIG. 5 is shown featuring an island 70. It will be appreciated that the region between the surface of the island 70 and the adjacent clamping ring surface will be pressurized to the pressure value prevailing around the island in the pocket 64. This is true because the major leak into the region above the island 70 will be provided by the pressurized zone within the pocket 64 surrounding the island, the leak occuring due to the infinitesimal clearance above the island. Such islands may be utilized as desired for practical purposes in forming the pockets, for example, in cases where pockets encompassing large areas are required.

A fourth pocket 72 is shown in FIG. 5 generally along the high pressure edge of the blade 40. The pocket 72 extends to the edge of the blade face and is therefore in fluid communication with the high pressure upstream area of the nozzle assembly for all configurations of the blade 40. Pressurization of the pocket 72 is achieved without the use of pressuring or venting slots. The portion of the actuator clamping ring 38 encompassed by the pocket 72 in any configuration of the blade 40 is thus exposed to high fluid pressure. Such constant pressure pockets may be positioned at virtually any location on the face of the blade 40 as desired and needed by the given application.

An alternate technique for venting the blade pockets is illustrated in FIG. 6. The pockets 62', 64' and 66' are each equipped with a throttled vent **62'*b*, 64'*b* and 66'*b*, respectively. The camming slot 54 (not shown) is utilized to selectively communicate high fluid pressure to the pockets 62'–66' by way of their respective gates, as described in relation to FIG. 5. However, the clamping ring 38 is not equipped with vent slots 68. Rather, the throttled vents 62'*b*–66'*b* are used to vent the high pressure fluid from the respective pockets. The throttled vents 62'*b*–66'*b*** are of sufficiently small cross section, particularly in comparison to the flow characteristics through the high pressure cam slot, that, where the gate of a pocket is meshed with the cam slot, leakage through the corresponding throttled vent is overcome so that the pocket is pressurized to the high pressure value incident to the cam slot. A pocket not in communication with the high pressure cam slot will be drained to low pressure through the pocket's throttled vent. It will be appreciated that such throttled vents may all be positioned to communicate with the low pressure outlet area of the nozzle assembly.

As a further alternate technique for venting the pockets to low pressure, the normal leakage of the pockets between the face of the blade and the adjacent clamping ring surface may be utilized to vent to low pressure pockets not in communication with the high pressure camming slot.

The various arrangements of blade pockets described thus far are positioned to control the fluid pressure acting on the surface, adjacent the blades, of the actuator clamping ring 38. However, such pockets may be positioned in each blade end wall which engages the surface A of the fixed clamping ring 36. Then, appropriate high and low pressure slots may be provided in the fixed clamping ring surface A to selectively pressurize the blade pockets as the blades are rotated about their corresponding pivot pins 52. In practice, it may generally be found desirable and/or necessary to provide pockets in both faces of the blades 40 to so alter the fluid pressure acting at the respective faces A and B of both clamping rings. In general, the number, shape and position of pockets so employed may be different on both faces of the blades as the requirements of the given application dictate. It may be expected that such practical requirements dictate symmetry between the two pocket patterns on the opposing blade walls. FIG. 7 illustrates such symmetry between pocket patterns, showing a single pocket 74 on the blade face that engages the actuator clamping ring 38. A corresponding pocket 74' is shown in phantom on the opposite blade face which engages the fixed clamping ring surface A. The holes **40*a* and 40*b* receive the pivot pins 52 and 56**, respectively.

Although pressurizing slots and throttled vents may be employed directly to control the pressurization of the pockets adjacent the fixed clamping ring surface A, these blade pockets may, instead, be connected by holes drilled through the blade 40 to corresponding pockets on the blade face which engages the actuator clamping ring surface B. For example, in FIG. 5 the pockets 62, 64 and 66 are each equipped with such fluid pressure communicating holes 76, 78 and 80, respectively. Whatever value of fluid pressure prevails in the pocket 62 will then be present in a corresponding pocket on the opposite face of the blade 40 with which the hole 76 communicates. Similarly, the holes 78 and 80 ensure pressurization of pockets adjacent the fixed clamping ring surface A equal to the pressure prevailing in the pockets 64 and 66, respectively. The cross sections of the holes 76–80 are sufficiently large to ensure relatively rapic response of pressure changes in the pockets adjacent the fixed clamping ring surface A in relation to pressure changes in the corresponding pockets adjacent the actuator clamping ring surface B.

Blade wall pockets according to the present invention may be employed in a given fluid flow control assembly where the adjacent clamping surfaces have been relieved in any manner, for example by tapering or grooving. In such case, one or more of the pockets may communicate with a relieved portion of the adjacent one or more clamping surfaces for one or more orientations of the blades. The blade pockets may be incorporated as an integral part of the technique for controlling the clamping forces by such clamping surface relieving, or may be utilized as a fine adjustment or correction in cases where the clamping surfaces have been relieved.

Figure 8:
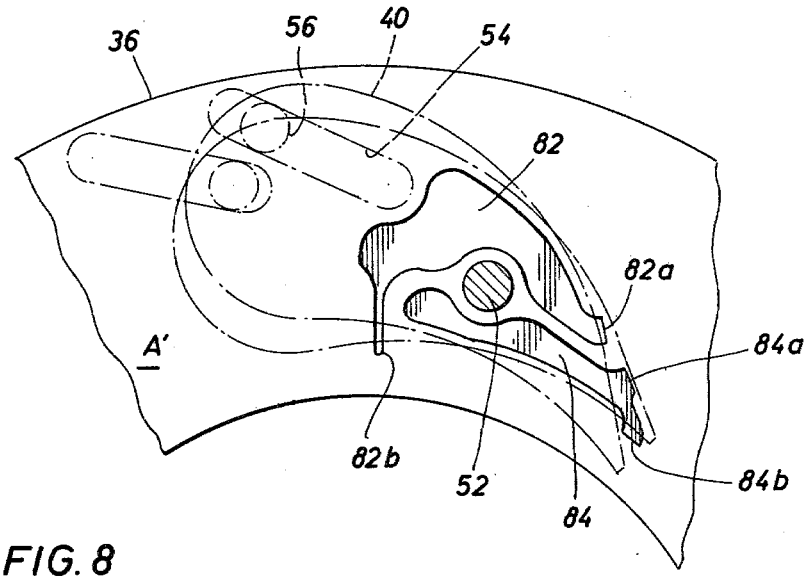
FIG. 8 is a plan view of a portion of the stationary ring surface illustrating a system of annular surface depressions in the stationary ring with two relative positions of a corresponding blade shown in phantom.

In FIG. 8 are illustrated two pockets 82 and 84 provided in a portion of the modified surface A' of the fixed ring 36. A blade 40 is shown in phantom superimposed on the surface segment A' in a wide open nozzle configuration and in a generally closed nozzle configuration as in FIG. 2. The corresponding positions of the cam slot 54 are also indicated in phantom. The pocket 82 is equipped with a gate 82*a* which is exposed to high pressure in the adjacent nozzle fluid flow passage when the blade 40 is positioned in the fully opened, or near-fully opened configuration as indicated. In that case, the pocket 82 is exposed to relatively high fluid pressure communicated through the port 82*a*. A capillary, or throttled venting orifice, 82*b* connects the pocket 82 with the low pressure region of the other adjacent nozzle fluid flow passage for all orientations of the blade 40. When the blade 40 is positioned to allow high fluid pressure to communicate through the port 82*a*, such high pressure fluid sufficiently floods the capillary 82*b* to sustain high fluid pressure within the pocket 82. For orientations of the blade 40 which seal the port 82*a* from fluid pressure communication, fluid pressure from the pocket 82 is vented through the capillary 82*b* to the low pressure region of the adjacent fluid flow passage.

The pocket 84 includes a port 84*a* which is exposed to fluid pressure communication for all positions of the blade 40 except those for which the adjacent fluid flow nozzle passages are generally closed or nearly so. For all other orientations of the blade 40, the port 84*a* exposes the pocket 84 to generally high fluid pressure. As the nozzle flow passages are closed by appropriate rotation of the blade 40, and the high pressure port 84*a* is sealed, a second port 84*b* is opened to communication with the low pressure area of the adjacent nozzle flow passage to vent fluid pressure from the pocket 84. For all other orientations of the blade 40, the low pressure vent 84*b* is sealed against low pressure communication, and the high pressure port 84*a* communicates high fluid pressure to the pocket 84.

Figure 9:
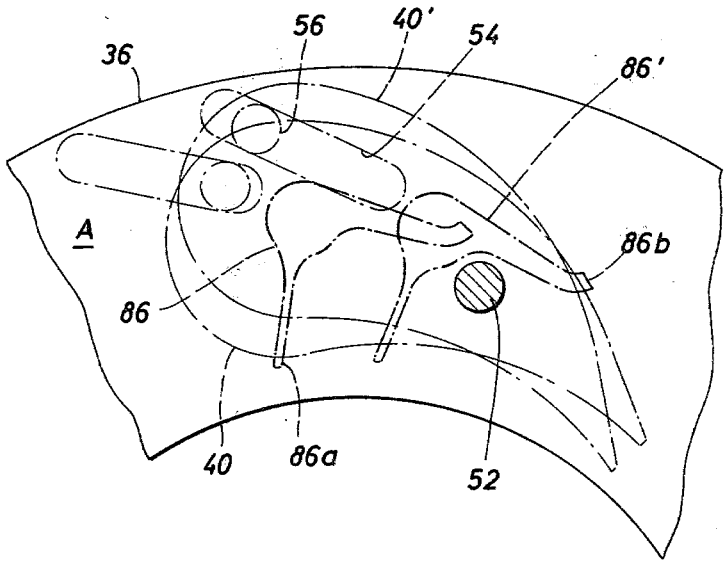
FIG. 9 is a plan view of a portion of the stationary ring illustrating, in phantom, two positions of a depression in the actuator ring surface superimposed on the blade also in phantom in corresponding orientations.

FIG. 9 illustrates the use of pockets in the surface B of the actuator ring 38. Two positions of a pocket 86 and 86′ are illustrated in phantom superimposed over corresponding two positions of a blade 40 and 40′, all viewed against the background of a segment of the surface A of the fixed ring 36. The corresponding two positions of the cam slot 54 are also illustrated. It will be appreciated that, as the actuator ring 38 is rotated about the turbine central axis to appropriately alter the orientation of the blade 40, the pocket 86 in the actuator ring surface B (not shown) rotates accordingly about the turbine central axis. The pocket 86 is equipped with a venting capillary, or throttled orifice, 86*a* which, for all configurations of the blade 40 and the actuator ring 38, is exposed to the low pressure area of the adjacent nozzle fluid flow passage. The pocket 86 also features a gate 86*b* which is exposed to high fluid pressure in the adjacent fluid flow passage only when the blade 40 is in a full-open configuration, or nearly so. For all other orientations of the blade 40, the gate 86*b* is sealed against fluid communication. Consequently, when the blade is in the position 40′, that is, with the adjacent fluid flow passages generally full open, the pocket 86 is exposed to high fluid pressure which floods the capillary 86*a* to maintain high pressure within the pocket. As the blade is moved from the configuration 40′, the gate 86*b* is sealed and the fluid pressure within the pocket 86 is vented through the capillary 86*a* to low pressure.

It will be appreciated that, while pockets in the clamping surfaces A and B are illustrated in FIGS. 8 and 9, respectively, in conjunction with just one blade in each case, the pattern of pockets may be repeated for the remaining blades, with or without variations, as needed. Variations in the shape, orientation, and number of pockets employed in one or both of the annular surfaces A and B of the fixed and movable rings, respectively, may be employed as needed to minimize variations in the clamping forces as the blades 40 are rotated about their respective pivot pins 52. Further, the techniques employed to expose such pockets to high and/or low pressure areas adjacent the corresponding blades may be varied as needed. For example, any combination of gates and/or vents may be utilized. Fluid pressure communicating holes such as 76, 78 and 80 (FIG. 5) may be positioned in the corresponding blades 40 to communicate fluid pressure between pockets in both annular surfaces A and B. Fluid pressure communication holes through the blades may also be used to communicate fluid pressure between annular surface pockets and the blade face pockets on the opposite side of the corresponding blades.

The pattern of pockets in the two surfaces A and B for a given blade need not be the same, or mutual mirror images. Additionally, pockets in one or both annular surfaces A or B may be used in conjunction with a pattern of one or more pockets in one or both faces of the corresponding blade 40, even though a blade face featuring such pockets is adjacent an annular surface equipped with pockets. In such cases, pockets in the annular surfaces may be operated independently of the blade face pockets. Alternatively, blade face pockets may be selectively overlapped with annular surface pockets.

Capillaries such as 82*b* and 86*a* may be utilized to expose the corresponding pockets to high pressure for wide ranges of blade orientation, with, for example, ports utilized to selectively vent the pockets to low pressure. In such cases, the pockets may be continually exposed to high pressure fluid except when fully vented to low pressure through the ports. The various ports, gates and vents may also be positioned to communicate both high and low fluid pressure to depressions depending on the blade configurations. Further, slots may be positioned in the blade faces to communicate fluid pressure relative to clamping surface depressions. For example, the connection between the blades 40 and the actuator ring 38 might employ pivot pins mounted on the ring 38 constrained by cam slots in the blades. Such blade cam slots could be used to communicate fluid pressure as well.

It will also be appreciated that the present invention is not limited to turbine applications, but may be employed with any type of fluid flow control assembly utilizing blades or vanes positioned between clamping surfaces. For example, the present invention may be applied to a variable vane diffuser in a compressor, or to fluid-handling rotating machinery in general.

The present invention provides a technique for controlling the clamping forces of fluid flow control assemblies by providing pockets in the blade faces engaging one or both of the parallel clamping surfaces, and/or one or both of the clamping surfaces, which pockets may be selectively pressurized to offset objectionable excessive or deficient clamping forces which may otherwise occur, for example, as the configuration of the blades is adjusted.

The foregoing disclosure and description of the present invention is illustrative and explanatory thereof, and various changes in the method steps as well as in the details of the illustrated apparatus may be made within the scope of the appended claims without departing from the spirit of the invention.

We claim:

1. A method of controlling clamping forces in fluid flow control assemblies comprising a plurality of blades, constrained generally between parallel clamping surfaces and movable relative thereto, comprising the following steps:

(a) locating one slot per blade in the face of one of the clamping surfaces communicating with a pressure source; and (b) locating at least one depression in the face of each blade adjacent the clamping surface with the slots such that, for at least one configuration of the blades relative to the clamping surfaces, a depression in each blade is in fluid communication with the corresponding slot.

2. An assembly for controlling fluid flow comprising:

(a) clamping means, including first and second opposed clamping surfaces;

(b) blades positioned generally between said first and second clamping surfaces and cooperating therewith to define fluid flow passages for controlling fluid flow, each said blade including a first face adjacent said first clamping surface and a second face adjacent said second clamping surface;

(c) mounting means for selectively retaining said blades to selectively adjust the cross-section of fluid flow passages; and (d) depressions in a plurality of at least one of said faces of said blades and said clamping surfaces and passageways in a plurality of at least one of said faces of said blades and said clamping surfaces, said depressions and passageways being constructed and arranged to provide selective communication between said depressions and said fluid flow passages as controlled by the orientation of said blades retained by said mounting means.

3. An assembly for controlling fluid flow comprising:

clamping means, including first and second opposed clamping surfaces;

blades positioned generally between said first and second clamping surfaces and cooperating therewith to define fluid flow passages, each said blade including a first face adjacent said first clamping surface and a second face adjacent said second clamping surface;

mounting means for selectively retaining said blades to define the cross-section of said fluid flow passages; and depressions located in said clamping surfaces adjacent at least a plurality of said blade faces and including slots extending in said clamping surfaces to positions selectively covered and uncovered by said blade faces responsive to the orientation of said blades.

4. An assembly for controlling fluid flow comprising:

(a) a housing, including a fluid inlet and a fluid outlet;

(b) a rotor rotatably mounted on an axis within said housing;

(c) a first annular surface positioned coaxially about said axis;

(d) a second annular surface positioned coaxially about said axis and axially displaced from said first annular surface;

(e) a plurality of blades positioned generally circumferentially about said axis and generally between said first and second annular surfaces for selectively directing fluid flow relative to said rotor;

(f) mounting means for selectively retaining the configurations of said blades relative to said rotor;

(g) a first face, as part of each of said blades, adjacent said first annular surface;

(h) a second face, as part of each of said blades, adjacent said second annular surface;

(i) said first and second annular surfaces and said blades cooperating to define a plurality of fluid flow passages whose cross-sections may be selectively varied as the configurations of the blades relative to the rotor are varied; and (j) depressions in a plurality of at least one of said faces of said blades in said clamping surfaces and passageways in a plurality of at least one of said faces of said blades and said clamping surfaces, said depressions and passageways being constructed and arranged to provide selective communication between said depressions and said fluid flow passages as controlled by the orientation of said blades selected by said adjustment means.

5. An assembly for controlling fluid flow comprising:

clamping means, including first and second opposed clamping surfaces;

blades positioned generally between said first and second clamping surfaces and cooperating therewith to define fluid flow passages for conducting fluid flow, each said blade including a first face adjacent said first clamping surface and a second face adjacent said second clamping surface;

mounting means for selectively retaining said blades to adjust the cross-section of said fluid flow passages; and depressions in a plurality of said faces of said blades, at least one of said clamping surfaces including passageways adjacent said faces of said blades constructed and arranged to be in selective communication with said depressions as controlled by the orientation of said blades retained by said mounting means.

6. The assebly of claim 5 wherein said depressions further include capillary passages extending to the edges of said faces of a plurality of said blades.

7. The assembly of claim 5 wherein said depressions are located on each of said first and second faces of a plurality of said blades.

8. The assembly of claim 7 further comprising holes extending from said depression on said first face to said depression on said second face of a plurality of said blades.

9. An assembly for controlling fluid flow comprising:

clamping means, including first and second opposed clamping surfaces;

blades positioned generally between said first and second clamping surfaces and cooperating therewith to define fluid flow passages for conducting fluid flow, each said blade including a first face adjacent said first clamping surface and a second face adjacent said second clamping surface;

mounting means for selectively retaining said blades to adjust the cross-section of said fluid flow passages; and depressions in a plurality of said faces of said blades, at least one of said clamping surfaces including passageways adjacent said faces of said blades constructed and arranged to be in selective communication with said depressions as controlled by the orientation of said blades retained by said mounting means; and said passageways extending on said clamping surfaces from locations adjacent said blade faces to locations adjacent said fluid flow passages.

10. The assembly of claim 9 wherein each blade includes a plurality of depressions on each of said first and second faces, said depressions on said face adjacent said passageway on each said blade including gates extending to the path of travel of said passageway relative to the face of said blade adjacent said passageway.

11. The assembly of claim 9 wherein at least some of said passageways include camming slots, said adjustment means including follower pins positioned in said camming slots and pivot pins about which each blade is constructed and arranged to pivot, said follower pins extending from said first faces of said blades and said pivot pins extending from said second faces of said blades.

12. The assembly of claim 9 or claim 11 wherein at least some of said passageways include vent slots extending to low pressure portions of said fluid flow passages.

13. An assembly for controlling fluid flow comprising:

clamping means, including first and second opposed clamping surfaces;

blades positioned between said first and second clamping surfaces and cooperating therewith to define fluid flow passages, each said blade including a first face adjacent said first clamping surface and a second face adjacent said second clamping surface;

mounting means for selectively retaining said blades to define the cross-section of said fluid flow passages, said mounting means including follower pins extending from said first faces of said blades to said first clamping surface and pivot pins extending from said second faces of said blades to said second clamping surface;

depressions in a plurality of said first and second faces of said blades; and passageways in at least one of said clamping surfaces, each said passageway extending from adjacent one said face of a said blade at a first end of said passageway to adjacent one said fluid flow passage at a second end of said passageway, said first end of said passageway extending into selective communication with one said depression as determined by the orientation of said blade.

14. The assembly of claim 13 wherein at least a plurality of said depressions include capillary passages extending from said depressions to the edge of said blade faces in communication with said fluid flow passages.

15. The assembly of claim 13 wherein at least a plurality of said passgeways are located in said first clamping surface and define camming slots receiving said follower pins.

16. The assembly of claim 15 wherein said depressions are located on corresponding first and second faces of said blades, each said blade including depressions therein having holes extending from said depression on said first face to said depression on said second face for communicating pressure therebetween.

* * * * *